US008456267B2

(12) United States Patent
Schoessow

(10) Patent No.: US 8,456,267 B2
(45) Date of Patent: Jun. 4, 2013

(54) HIGH-IMPEDANCE DC-ISOLATING TRANSMISSION LINE TRANSFORMERS

(75) Inventor: Michael J. Schoessow, Belmont, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 88 days.

(21) Appl. No.: 12/780,775

(22) Filed: May 14, 2010

(65) Prior Publication Data

US 2011/0279209 A1 Nov. 17, 2011

(51) Int. Cl.

| | |
|---|---|
| ***H01F 27/29*** | (2006.01) |
| ***H01F 27/28*** | (2006.01) |
| ***H01P 5/04*** | (2006.01) |
| ***H01F 5/04*** | (2006.01) |

(52) U.S. Cl.
CPC ... *H01F 5/04* (2013.01); *H01P 5/04* (2013.01)
USPC ..... 336/192; 336/180; 336/182; 333/24 R; 333/25

(58) Field of Classification Search
USPC ..... 336/187, 188, 189, 192
See application file for complete search history.

(56) References Cited

U.S. PATENT DOCUMENTS

| | | | | |
|---|---|---|---|---|
| 2,399,382 | A * | 4/1946 | Polydoroff | 343/788 |
| 2,860,312 | A * | 11/1958 | Krepps, Jr. | 336/69 |
| 3,033,997 | A * | 5/1962 | Salihi | 327/412 |
| 3,195,076 | A * | 7/1965 | Morrison | 333/26 |
| 3,277,416 | A * | 10/1966 | Barr | 336/84 R |
| 3,305,800 | A * | 2/1967 | Velsink | 333/32 |
| 3,449,704 | A * | 6/1969 | Matsushima et al. | 336/175 |
| 3,609,613 | A | 9/1971 | Horn et al. | |
| 4,628,430 | A * | 12/1986 | Mastner | 363/25 |
| 5,091,708 | A | 2/1992 | Bezjak | |
| 5,414,309 | A * | 5/1995 | Ichikawa et al. | 327/110 |
| 5,808,518 | A | 9/1998 | McKinzie, III et al. | |
| 6,140,887 | A | 10/2000 | Zheng | |
| 6,337,608 | B1 | 1/2002 | McLean et al. | |
| 6,642,827 | B1 * | 11/2003 | McWilliams et al. | 336/107 |
| 6,731,482 | B2 * | 5/2004 | Juncu | 361/42 |
| 6,876,528 | B2 * | 4/2005 | Macbeth | 361/42 |
| 7,030,694 | B2 * | 4/2006 | Jonkman | 330/251 |
| 7,456,631 | B1 | 11/2008 | Shino | |
| 7,696,852 | B1 * | 4/2010 | Harding | 336/200 |
| 2006/0152270 | A1 * | 7/2006 | Buerkert | 327/333 |

OTHER PUBLICATIONS

Buckles, R., "The STLT—An Ultra-Wideband High-Ratio Pulse Transformer", DOE/NV/11718-780 pp. 323-326 , Dec . 1989.
Trask, Chris, "Designing Wide-band Transformers for HF and VHF Power Amplifiers", QEX Mar./Apr. 2005, pp. 3-15.
Sevick, Jerry, "A Simplified Analysis of the braodband Transmission Line Transformer", Feb. 2004, High Frequency Electronics, pp. 48-53.

(Continued)

*Primary Examiner* — Mohamad Musleh
*Assistant Examiner* — Joselito Baisa

(57) ABSTRACT

A composite transmission line transformer includes at least one core, a first port, a second port, and one or more pairs of transmission lines wound about the core(s). Each transmission line is in signal communication with the first port and the second port. For each pair, the transmission lines are interconnected in series at the first port and at the second port such that the first port and the second port are DC-isolated from each other.

20 Claims, 6 Drawing Sheets

OTHER PUBLICATIONS

Guanella, G., "New Method of Impedance matching in Radio-Frequency Circuits", Borwn Boveri Review, Sep. 1944, pp. 327-329.

Sevick, J., "Transmission Line Transformers". 4th ed., SciTech Publishing Inc., 2001, 21pgs.

C.L. Ruthroff, "Some Broad-Band Transformers", Proc. IRE, vol. 47, pp. 1337-1342, Aug. 1959.

Myer, D. "Synthesis of Equal Delay Transmission Line Transformer Networks", Microwave Journal, vol. 35, No. 3, pp. 106-114, Mar. 1992.

* cited by examiner

HIGH-IMPEDANCE DC-ISOLATING TRANSMISSION LINE TRANSFORMERS

FIELD OF THE INVENTION

The present invention relates generally to transmission line transformers. More particularly, the present invention relates to a family of transmission line transformers exhibiting high-impedance while utilizing relatively lower-impedance transmission lines, while exhibiting DC isolation between input and output ports and providing a center tap at each port.

BACKGROUND OF THE INVENTION

A transmission line transformer transmits electromagnetic energy by way of the traverse electromagnetic mode (TEM), or transmission line mode, instead of by way of the coupling of magnetic flux as in the case of a conventional transformer. The design and theory of various transmission line transformers are described in Sevick, J., "Transmission Line Transformers,"4$^{th}$ ed., *Noble Publishing Corp.,* 2001.

FIG. 1 is a schematic illustration of a Guanella-type 1:1 transmission line transformer (TLT) 100. The TLT 100 generally includes a single, two-conductor transmission line 110 in signal communication with a two-terminal input port 112 and a two-terminal output port 114. The transmission line 110 includes a first electrical conductor 122 and a second electrical conductor 124 wound or coiled around (or threaded through) a magnetic core 126. The magnetic core 126 is typically constructed of a solid material such as ferrite or powdered iron. The TLT 100 illustrated provides an impedance transformation ratio of 1:1. That is, the output voltage and current replicate the input voltage and current. The usefulness of this type of transformer derives from the fact that the common-mode input and output potentials can differ from each other. In other words, the TLT 100 can support a longitudinal voltage drop between its input port 112 and output port 114. Although a conventional transformer also accomplishes this, the advantage of the TLT 100 is that its loss and bandwidth are greatly superior to those of a conventional transformer. These advantages are largely related to the properties of the transmission line 110 rather than the properties of the core 126.

In practice, a transmission line transformer such as shown in FIG. 1 may be constructed by winding a length of transmission line onto a ferrite or powdered iron core, or by stringing cores onto the transmission line like beads. Typical configurations of an actual transmission line include coaxial cable, twisted-pair wires, twin-lead ribbon cable, strip line, and microstrip, all of which are known to persons skilled in the art.

The Guanella-type 1:1 TLT 100 is the basic building block for more elaborate transmission-line transformer circuits. It may be employed with the input port and the output port each having one terminal grounded. Alternatively, it may be operated with both the input port and the output port floating, or balanced, with respect to ground. Alternatively, it may be operated with one of the ports floating, that is, not referenced to ground or any other point. In the latter configuration, a common use for a transmission line transformer is to convert a signal source voltage that is balanced with respect to ground to one that is referenced to ground (commonly referred to as unbalanced). A transmission line transformer utilized in this way is commonly referred to as a balun (i.e., balanced-to-unbalanced). FIGS. 2A-2D illustrate the four different configurations. Specifically, FIG. 2A illustrates both ports floating, FIG. 2B illustrates the input port unbalanced and the output port floating, FIG. 2C illustrates the input port floating and the output port unbalanced, and FIG. 2D illustrates both ports unbalanced.

The input and output impedances of a 1:1 Guanella transmission-line transformer as illustrated in FIG. 1 are equal to the impedance of the transmission line utilized to construct the transformer when each port is terminated in that same impedance. Various ways are known to connect one or more 1:1 transformers to produce composite transformers possessing impedance transformations other than 1:1, and in all of these cases the impedance of the transmission line differs from both the input and output impedances of the composite transformer.

Three prominent families of impedance-transforming transmission-line transformers are known. These three families are usually referred to as Guanella, Ruthroff, and Equal Delay, with the latter being a phase-corrected version of the Ruthroff configuration. Each of these families is capable of impedance transformations of $N^2$ where N is any positive integer. In addition to these three main families there are various other connection schemes that can yield impedance transformations of N/M where N and M are positive integers. All of these transformers have one thing in common: the impedance of the transmission line used to construct the transformer must be equal to the square root of the transformer input impedance times the transformer output impedance. For example, to construct a transformer that transforms between 50 ohms and 200 ohms (N=2), the transmission line utilized to construct the transformer must possess a characteristic impedance of $\sqrt{(50\times200)}=100$ ohms FIG. 3 shows a 1:9 Guanella transmission-line transformer circuit 300 that transforms between 50 ohms and 450 ohms This transformer circuit 300 utilizes three basic 1:1 transformers 302, 304, 306 with their inputs connected in parallel on the side of an input port 312 and their outputs connected in series on the side of an output port 314. The required characteristic impedance of the transmission line material used to construct this transformer circuit 300 is $\sqrt{(50\times450)}=150$ ohms Note that at the input the parallel connection of three 150-ohm transmission lines yields a net impedance of 50 ohms (150 divided by 3) while the output connection of the three lines in series gives $3\times150=450$ ohms In this known configuration, the three separate 1:1 transformers 302, 304, 306 are constructed on three separate cores 326, 328, 332 using the 150-ohm transmission line material, thus requiring a large footprint as compared to the basic single-core 1:1 transformer.

The two most common forms of transmission line utilized to construct transmission-line transformers are twin-lead (bonded side-by-side or twisted pair) and coaxial cable. Because coaxial cable is self-shielding it has advantages over twin-lead, especially when the transformer is required to work at both high power and at high frequencies where parasitic circuit elements can compromise performance. Unfortunately practical small-diameter coaxial cable is limited to upper impedance levels of about 100 ohms, with 18 to 75 ohms being much more common. Although high-impedance twin-lead can be readily constructed, it is physically large. Such twin-lead is typically used in large, very high power high-impedance transformers. For very small transformers, such as would be mounted on printed circuit boards (PCBs), the twin-lead is constructed from small-gauge bonded or twisted enamel-insulated magnet wire, and this is limited to impedances typically between 35 and 75 ohms, with 50 ohms being, by far, the most common.

Accordingly, there is a need for providing transmission line transformers having at least one high-impedance port without requiring the use of high-impedance transmission line material. In addition, there is a need for transmission line transformers that are DC-isolating between input ports and output ports, capable of providing broadband center-tap connection points at both input and output ports, and capable of operating with either or both ports floating or unbalanced while requiring only a single core for construction.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a composite transmission line transformer includes at least one core, a first port, a second port, and one or more pairs of transmission lines wound about the core(s). Each transmission line is in signal communication with the first port and the second port. For each pair, the transmission lines are interconnected in series at the first port and at the second port such that the first port and the second port are DC-isolated from each other.

In some implementations, at least one of the ports has a center tap. In other implementations, both the ports have respective center taps. Additionally, a given port may have more than one tap associated with it.

In various implementations, the composite transmission line transformer has a port configuration in which both the first port and the second port are floating, or both the first port and the second port are unbalanced, or one of the first port and the second port is floating and the other is unbalanced. Each port configuration is available in the case where a single core is provided in the construction of the transformer, and in the case where more than one core is provided.

In some implementations, the first port is configured to exhibit a first port voltage, and the second port is configured to exhibit a second port voltage phase-inverted relative to the first port voltage.

In some implementations, the first port has a first port impedance, the second port has a second port impedance, the transmission lines have a characteristic line impedance, and the one or more pairs of transmission lines are interconnected at each port such that the first port impedance is equal to or greater than the characteristic line impedance and the second port impedance is equal to or greater than the characteristic line impedance.

In some implementations, the first port has a first port impedance, the second port has a second port impedance, the transmission lines have a characteristic line impedance, and the one or more pairs of transmission lines are interconnected at each port such that the first port impedance is equal to or less than the characteristic line impedance and the second port impedance is equal to or less than the characteristic line impedance.

In some implementations, the first port has a first port impedance, the second port has a second port impedance, the transmission lines have a characteristic line impedance, and the one or more pairs of transmission lines are interconnected at each port such that one of the first port impedance and the second port impedance is greater than the characteristic line impedance and the other port impedance is less than the characteristic line impedance.

In some implementations, the first port has a first port impedance, the second port has a second port impedance, the transmission lines have a characteristic line impedance, and the one or more pairs of transmission lines are interconnected at each port such that at least one of the first port impedance and the second port impedance is greater than the characteristic line impedance by a factor of at least two.

In some implementations, the impedance transformation ratio in a direction from the first port to the second port is $1:N^2$ where N is any positive integer.

In various implementations, the first port may be utilized as an input port while the second port is utilized as an output port. Alternatively, the first port may be utilized as an output port while the second port is utilized as an input port.

According to another implementation, a method is provided for forming a composite transmission line transformer consistent with any of the above-summarized implementations.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

To address the problems discussed above, a new family of composite transmission line transformers (TLTs) is disclosed herein. These TLTs are "composite" transformers in the sense that they effectively include two or more transformers and may be constructed from two or more separate lengths of transmission line material. In general, these TLTs utilize combinations of series connections, parallel connections, and series-parallel connections at their input and output ports in such a manner that there is a significant relaxing in the requirement for the impedance of the transmission line material utilized to construct the TLT. This is particularly useful in the case of TLTs having at least one high-impedance port. Moreover, there is no DC connection between the input and output ports. In general, the composite transformers are constructed from an even number of separate transmission lines. At each port the transmission lines are first connected in series, in pairs, in such a manner that there is DC isolation between the ports and one or more center taps are available at each port. In the case of transformers employing more than one pair of transmission lines, the pairs of lines are then further connected in series or parallel combinations to establish the desired port impedances. Non-limiting examples of TLTs consistent with the present teachings are described below with reference to FIGS. 4-8.

Figure 1:
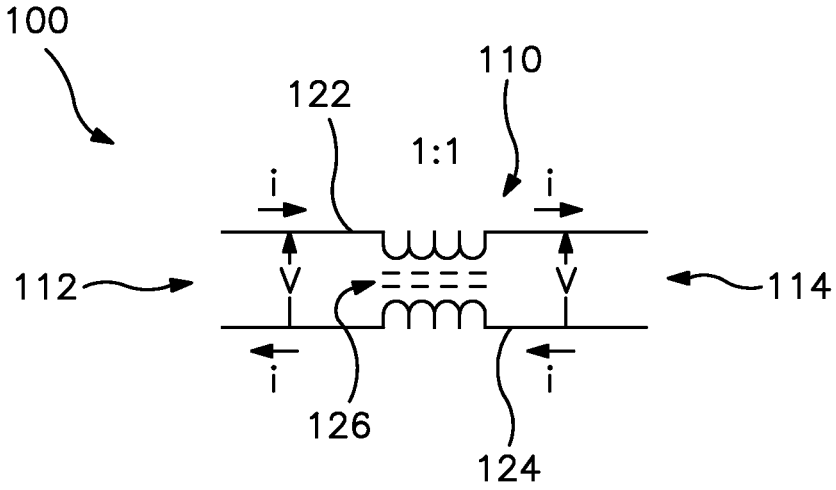
FIG. 1 PRIOR ART
FIG. 1 is a schematic view of a 1:1 Guanella transmission line transformer (TLT) of known configuration.
Figure 2:
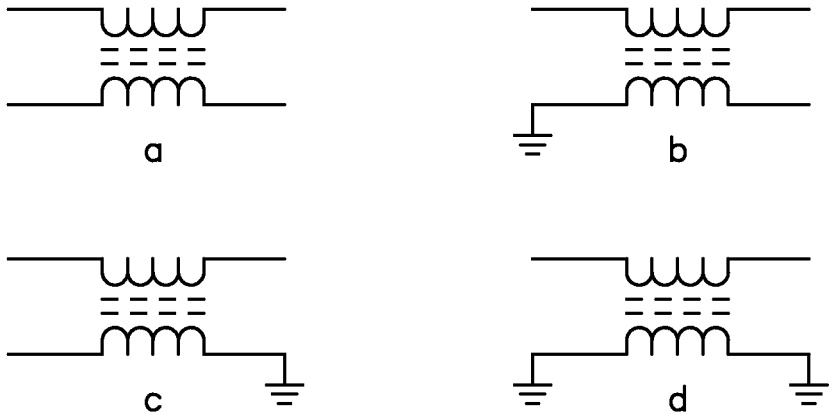
FIG. 2 PRIOR ART
FIGS. 2A-2D are schematic views of the 1:1 TLT illustrated in FIG. 1 with the following respective port configurations: both ports floating, input port unbalanced and output port floating, input port floating and output port unbalanced, and both ports unbalanced.
Figure 3:
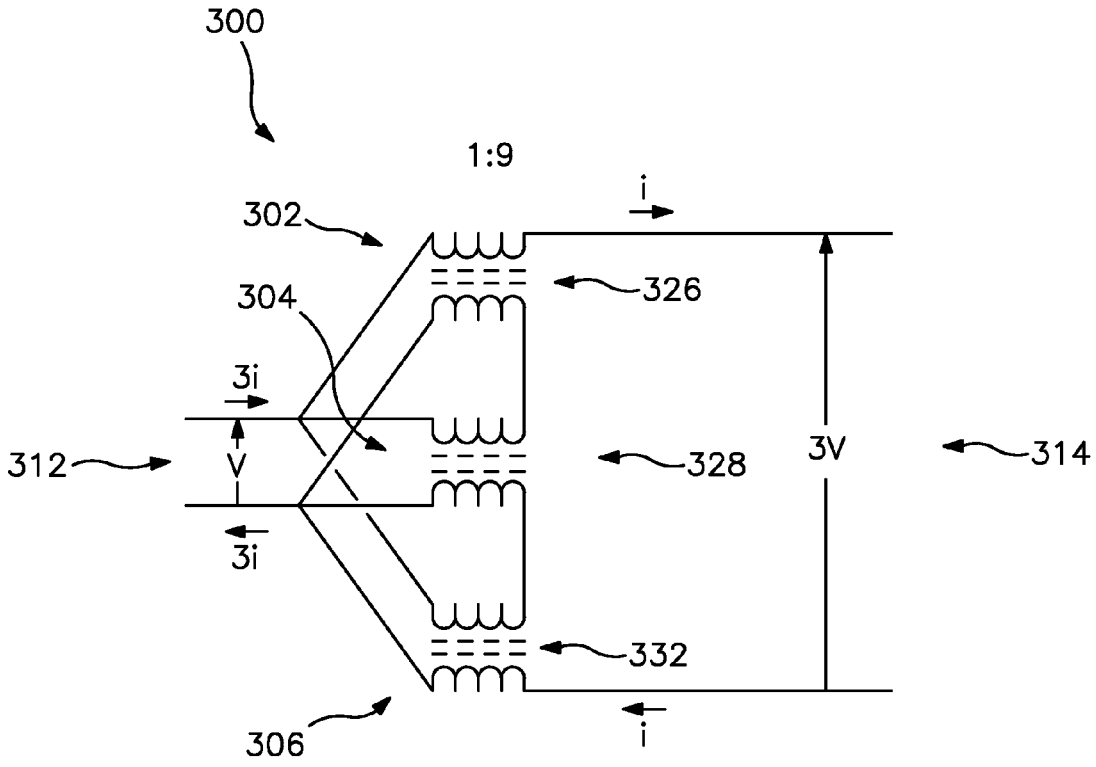
FIG. 3 PRIOR ART
FIG. 3 is a schematic view of a 1:9 Guanella TLT circuit of known configuration.
Figure 4:
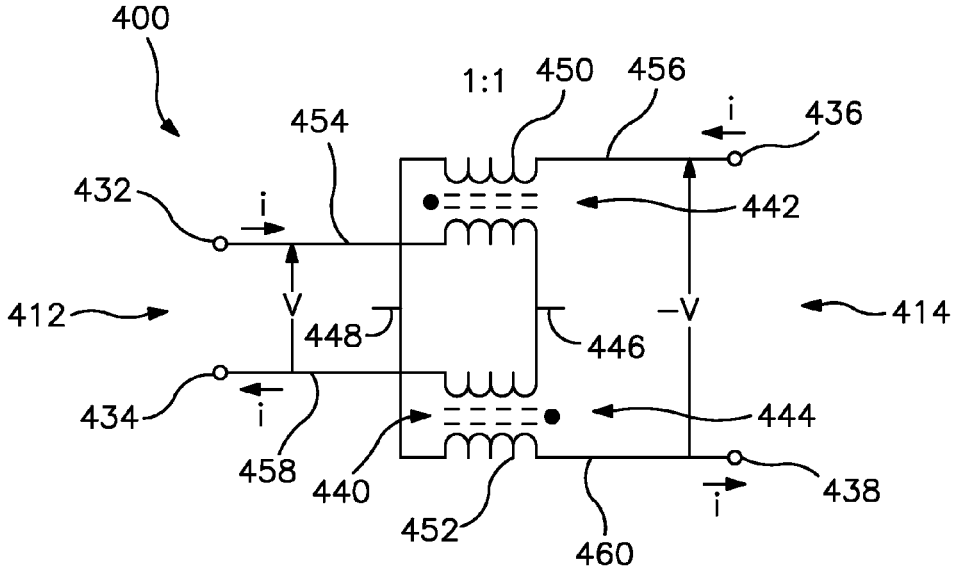
FIG. 4 is a schematic view of an example of a composite TLT provided in accordance with one implementation of the present teachings.

FIG. 4 is a schematic view of an example of a composite transmission line transformer (TLT) 400 provided in accordance with one implementation of the present teachings. The TLT 400 generally includes a first port 412, a second port 414, and transformer circuitry in signal communication with the first port 412 and the second port 414. The first port 412 generally includes a first node 432 (or terminal) and a second node 434 (or terminal). The first port 412 has a first port impedance R, and exhibits a first port voltage between the first node 432 and the second node 434. In the present context, the term "exhibits" refers to either "receives" or "produces" depending on whether the first port 412 is utilized as an input port or an output port, respectively. The second port 414 generally includes a first node 436 (or terminal) and a second node 438 (or terminal). The second port 414 has a second port impedance R, and exhibits (produces or receives) a second port voltage between the first node 436 and the second node 438. The circuitry between the first port 412 and the second port 414 generally includes at least one core 440, i.e., one or more cores 440, having any configuration and material composition (solid or air) suitable for constructing transmission line transformers. The circuitry further generally includes a first transmission line 442 and a second transmission line 444, at least portions of which are wound about the core(s) 440. The transmission lines 442, 444 may have any suitable two-conductor transmission line configuration. In some implementations, the circuitry provides one or more center taps at one or both ports. In the illustrated example, a first center tap 446 is associated with the first port 412 and a second center tap 448 is associated with the second port 414.

The TLT 400 is configured—i.e., the electrical conductors are interconnected, connected to the ports 412, 414, and wound about the core(s) 440—in a manner that provides the following features. The TLT 400 provides a transformation ratio of 1:1 but differs from 1:1 transformers described by the prior art in five significant ways. First, there are two windings (or wound portions) instead of one. Specifically, the first transmission line 442 includes a first wound portion 450 and the second transmission line 444 includes a second wound portion 452. The two wound portions 450, 452 may both be wound onto the same core 440, however, so the physical size of the circuit will be similar to that of the Guanella or Ruthroff design. Alternatively, separate cores may be provided for each wound portion 450, 452. The dots in FIG. 4 indicate that the two wound portions 450, 452 are wound in opposite directions on the core 440 so the flux lines couple in a reinforcing manner. This also reduces the number of turns required in each winding as compared to if they were wound on separate cores. Thus, the first wound portion 450 is wound in a first winding direction and the second wound portion 452 is wound in a second winding direction that is opposite to the first winding direction. Second, the impedance looking into either the first port 412 or the second port 414 is equal to twice the impedance of the transmission line used to construct the circuit, assuming that the port not being looked into is terminated in the same impedance. In other words, $Z_0$=R/2 where $Z_0$ is the line impedance and R is the port impedance of the first port 412 as well as the second port 414. This results from the two transmission lines 442, 444 being connected in series at both ports 412, 414. Third, the first port 412 and the second port 414 are DC-isolated from each other. Fourth, as an option the circuit is capable of providing center taps 446, 448 for both the input port 412 and the output port 414. Fifth, the TLT 400 is overall inverting—that is, the first port voltage, V, is phase-inverted relative to the second port voltage, −V.

FIG. 4 illustrates one way of realizing the foregoing features. The first transmission line 442 includes a first conductor 454 and a second conductor 456, portions of which are wound about the core 440 to form the first wound portion 450. The second transmission line 444 likewise includes a first conductor 458 and a second conductor 460, portions of which are wound about the core 440 to form the second wound portion 452 in the opposite sense to the first wound portion 450. For purposes of descriptively referring to the schematic of FIG. 4, the first wound portion 450 and the second wound portion 452 will be characterized as having respective first "ends" on the side of the first port 412 (the left side of the schematic) and respective second "ends" on the side of the second port 414 (the right side of the schematic). At the first end of the first wound portion 450, the first conductor 454 of the first transmission line 442 is in signal communication with the first node 432 of the first port 412. Also at the first end of the first wound portion 450, the second conductor 456 of the first transmission line 442 is in signal communication with the second conductor 460 of the second transmission line 444 (at the first end of the second wound portion 452). At the second end of the first wound portion 450, the second conductor 456 of the first transmission line 442 is in signal communication with the first node 436 of the second port 414. Also at the second end of the first wound portion 450, the first conductor 454 of the first transmission line 442 is in signal communication with the first conductor 458 of the second transmission line 444 (at the second end of the second wound portion 452). At the first end of the second wound portion 452, the first conductor 458 of the second transmission line 444 is in signal communication with the second node 434 of the first port 412. At the second end of the second wound portion 452, the second conductor 460 of the second transmission line is in signal communication with the second node 438 of the second port 414. By this configuration, the first transmission line 442 and the second transmission line 444 are connected in series at the first port 412 as well as at the second port 414.

In some implementations, a first center tap 446 associated with the first port 412 and/or a second center tap 448 associated with the second port 414 may be provided. In the example illustrated in FIG. 4, the first center tap 446 is implemented between the first wound portion 450 and the second wound portion 452 at the first port 412, and the second center tap 448 is implemented between the first wound portion 450 and the second wound portion 452 at the second port 414. This tap configuration is realized by locating the first center tap 446 at the node between the first conductor 454 of the first transmission line 442 and the first conductor 458 of the second transmission line 444, and locating the second center tap 448 at the node between the second conductor 456 of the first transmission line 442 and the second conductor 460 of the second transmission line 444.

The TLT 400 avoids the requirement for high-impedance coaxial cable or twin-lead when constructing transmission-line circuits having at least one high-impedance port. As an example, a typical use for the TLT 400 is in interfacing between circuit elements such as digital-to-analog converters, multipliers, mixers, etc. that operate with balanced 100-ohm inputs and/or outputs. In such a case the transmission line used to construct the transformer should possess a characteristic impedance of 50 ohms As with the Guanella 1:1 transformer, the 1:1 TLT 400 may be utilized with either or both ports 412, 414 referenced to ground or floating, as shown by analogy in FIGS. 2A-2D. The center taps 446, 448 of the TLT 400 may be usefully employed to feed bias or DC power to the circuit modules between which it is connected. The DC isolation between the ports 446, 448 of the TLT 400 may alleviate the need for blocking capacitors in some applications.

Figure 5:
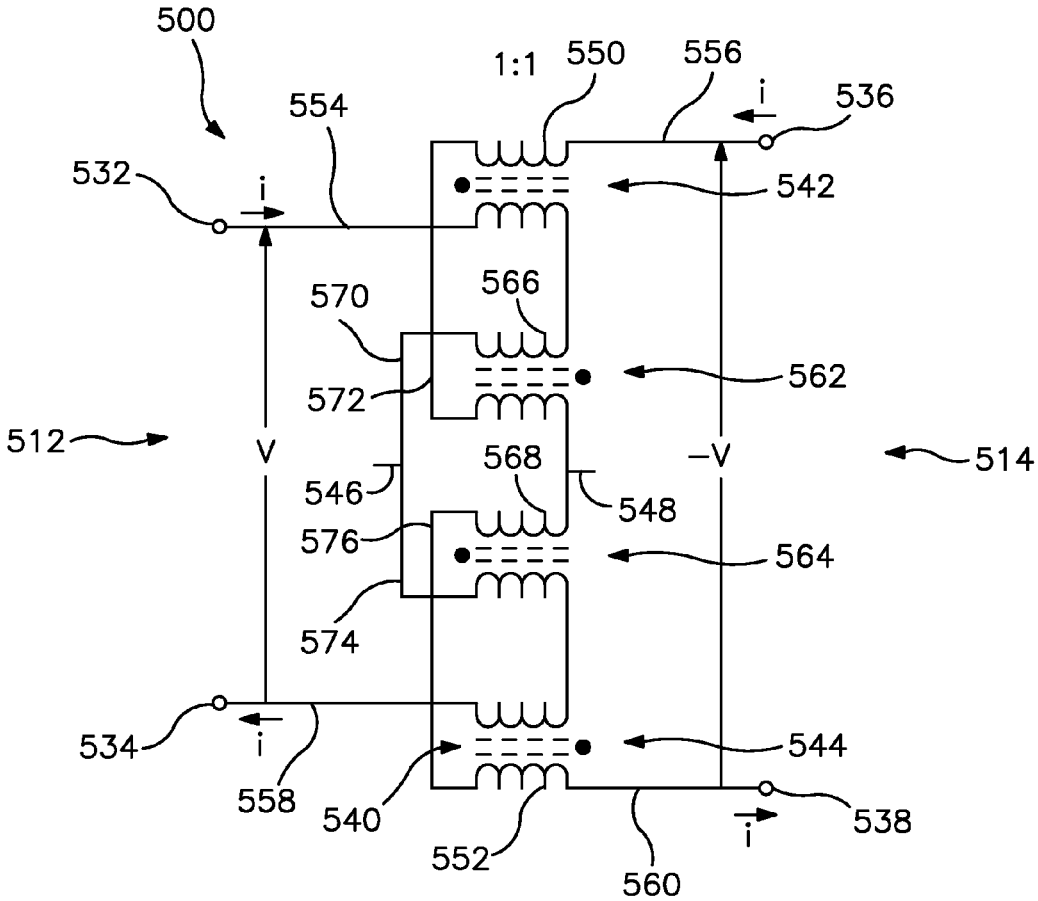
FIG. 5 is a schematic view of an example of a composite TLT provided in accordance with another implementation of the present teachings.

FIG. 5 is a schematic view of an example of a composite TLT 500 provided in accordance with another implementation of the present teachings. The TLT 500 generally includes a first port 512, a second port 514, and transformer circuitry in signal communication with the first port 512 and the second port 514. The first port 512 generally includes a first node 532 and a second node 534. The first port 512 has a first port impedance R, and exhibits a first port voltage between the first node 532 and the second node 534. The second port 514 generally includes a first node 536 and a second node 538. The second port 514 has a second port impedance R, and exhibits a second port voltage between the first node 536 and the second node 538. The circuitry between the first port 512 and the second port 514 generally includes at least one core 540. The circuitry further generally includes a first transmission line 542, a second transmission line 544, a third transmission line 562, and a fourth transmission line 564, at least portions of which are wound about the core(s) 540. Specifically, the first transmission line 542 includes a first wound portion 550, the second transmission line 544 includes a second wound portion 552, the third transmission line 562 includes a third wound portion 566, and the fourth transmission line 564 includes a fourth wound portion 568. The four wound portions 550, 552, 566, 568 may all be wound onto the same common core 540 or one or more separate cores. As indicated by the dots in FIG. 5, the first wound portion 550 is wound in a first winding direction and the second wound portion 552 is wound in a second winding direction that is opposite to the first winding direction. The third wound portion 566 is wound in the second winding direction and the fourth wound portion 568 is wound in the first winding direction. In some implementations, the circuitry provides one or more center taps. In the illustrated example, a first center tap 546 is associated with the first port 512 and a second center tap 548 is associated with the second port 514.

The TLT 500 is configured in a manner that provides the following features. The TLT 500 provides a transformation ratio of 1:1 and a port impedance equal to four times the characteristic impedance of the transmission line utilized to construct the windings. In other words, $Z_0$=R/4 where $Z_0$ is the line impedance and R is the port impedance of the first port 512 as well as the second port 514. As in the other implementation described above, the first port 512 and the second port 514 are DC-isolated from each other. Also, as an option the circuit is capable of providing center taps 546, 548 for both the input port 512 and the output port 514. Moreover, the TLT 500 is overall inverting—that is, the first port voltage, V, is phase-inverted relative to the second port voltage, −V.

FIG. 5 illustrates one way of realizing the foregoing features. The circuit arrangement is generally similar to that of FIG. 4, except for the addition of the third transmission 562 and the fourth transmission line 564 in series connection between the first transmission line 542 and the second transmission line 544. The first transmission line 542 includes a first conductor 554 and a second conductor 556, portions of which are wound about the core 540 to form the first wound portion 550. The second transmission line 544 includes a first conductor 558 and a second conductor 560, portions of which are wound about the core 540 to form the second wound portion 552 in the opposite sense to the first wound portion 550. The third transmission line 562 includes a first conductor 570 and a second conductor 572, portions of which are wound about the core 540 to form the third wound portion 566 in the opposite sense to the first wound portion 550. The fourth transmission line 564 includes a first conductor 574 and a second conductor 576, portions of which are wound about the core 540 to form the fourth wound portion 568 in the opposite sense to the third wound portion 566.

Continuing with FIG. 5, at the first end of the first wound portion 550, the first conductor 554 of the first transmission line 542 is in signal communication with the first node 532 of the first port 512. Also at the first end of the first wound portion 550, the second conductor 556 of the first transmission line 542 is in signal communication with the second conductor 572 of the third transmission line 562 (at the first end of the third wound portion 566). At the second end of the first wound portion 550, the second conductor 556 of the first transmission line 542 is in signal communication with the first node 536 of the second port 514. Also at the second end of the first wound portion 550, the first conductor 554 of the first transmission line 542 is in signal communication with the first conductor 570 of the third transmission line 562 (at the second end of the third wound portion 566). At the first end of the second wound portion 552, the first conductor 558 of the second transmission line 544 is in signal communication with the second node 534 of the first port 512. Also at the first end of the second wound portion 552, the second conductor 560 of the second transmission line 544 is in signal communication with the second conductor 576 of the fourth transmission line 564 (at the first end of the fourth wound portion 568). At the second end of the second wound portion 552, the second conductor 560 of the second transmission line 544 is in signal communication with the second node 538 of the second port 514. Also at the second end of the second wound portion 552, the first conductor 558 of the second transmission line 544 is in signal communication with the first conductor 574 of the fourth transmission line 564 (at the second end of the fourth wound portion 568). At the first end of the third wound portion 566, the first conductor 570 of the third transmission line 562 is in signal communication with the first conductor 574 of the fourth transmission line 564 (at the first end of the fourth wound portion 568). At the second end of the third wound portion 566, the second conductor 572 of the third transmission line 562 is in signal communication with the second conductor 576 of the fourth transmission line 564 (at the second end of the fourth wound portion 568). By this configuration, the first transmission line 542 , the second transmission line 544, the third transmission line 562, and the fourth transmission line 564 are connected in series at the first port 512 as well as at the second port 514.

In some implementations, a first center tap 546 associated with the first port 512 and/or a second center tap 548 associated with the second port 514 may be provided. In the example illustrated in FIG. 5, the first center tap 546 is implemented between the first wound portion 550 and the second wound portion 552 (and more specifically between the third wound portion 566 and the fourth wound portion 568) at the first port 512, and the second center tap 548 is implemented between the first wound portion 550 and the second wound portion 552 (and more specifically between the third wound portion 566 and the fourth wound portion 568) at the second port 514. This tap configuration is realized by locating the first center tap 546 at the node between the first conductor 570 of the third transmission line 562 and the first conductor 574 of the fourth transmission line 564, and locating the second center tap 548 at the node between the second conductor 572 of the third transmission line 562 and the second conductor 576 of the fourth transmission line 564.

As in the other implementation described above, the TLT 500 avoids the requirement for high-impedance coaxial cable or twin-lead when constructing transmission-line circuits having at least one high-impedance port. The attribute of $Z_0$=R/4 enables, for example, the TLT 500 to be constructed as a 200-ohm transformer using 50-ohm transmission line material or as a 300-ohm transformer using 75-ohm transmission line material. Also, the 1:1 TLT 500 may be utilized with either or both ports 512, 514 referenced to ground or floating. The center taps 546, 548 of the TLT 500 may be utilized to provide DC bias or power as noted above. The TLT 500 provides DC isolation between the ports 512, 514.

Figure 6:
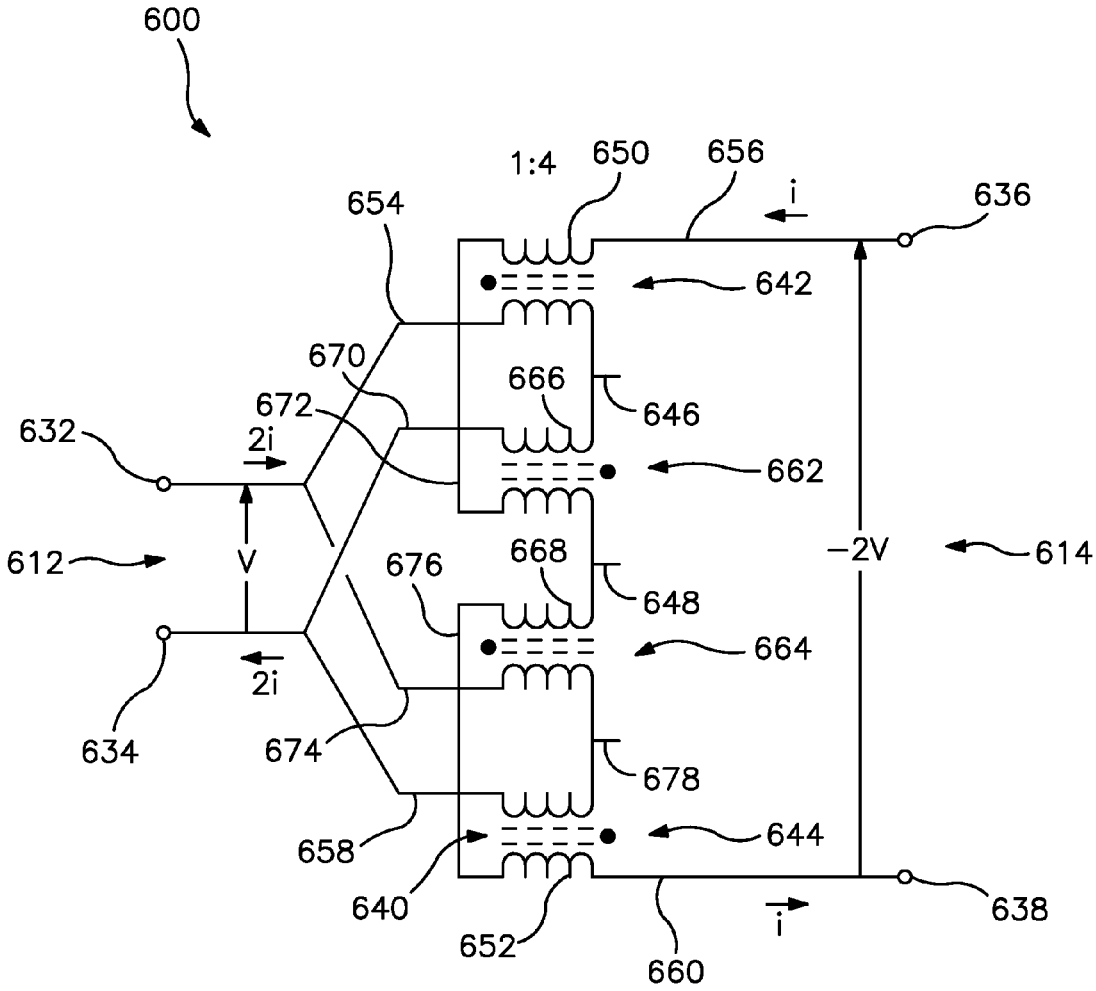
FIG. 6 is a schematic view of an example of a composite TLT provided in accordance with another implementation of the present teachings.

FIG. 6 is a schematic view of an example of a composite TLT 600 provided in accordance with another implementation of the present teachings. The TLT 600 generally includes a first port 612, a second port 614, and transformer circuitry in signal communication with the first port 612 and the second port 614. The first port 612 generally includes a first node 632 and a second node 634. The first port 612 has a first port impedance R, and exhibits a first port voltage between the first node 632 and the second node 634. The second port 614 generally includes a first node 636 and a second node 638. The second port 614 has a second port impedance 4R, and exhibits a second port voltage between the first node 636 and the second node 638. The circuitry between the first port 612 and the second port 614 generally includes at least one core 640. The circuitry further generally includes a first transmission line 642, a second transmission line 644, a third transmission line 662, and a fourth transmission line 664, at least portions of which are wound about the core(s) 640. Specifically, the first transmission line 642 includes a first wound portion 650, the second transmission line 644 includes a second wound portion 652, the third transmission line 662 includes a third wound portion 666, and the fourth transmission line 664 includes a fourth wound portion 668. The four wound portions 650, 652, 666, 668 may all be wound onto the same common core 640 or one or more separate cores. As indicated by the dots in FIG. 6, the first wound portion 650 is wound in a first winding direction and the second wound portion 652 is wound in a second winding direction that is opposite to the first winding direction. The third wound portion 666 is wound in the second winding direction and the fourth wound portion 668 is wound in the first winding direction. In some implementations, the circuitry provides one or more center taps. In the illustrated example, a first center tap 646, 678 is associated with the first port 612 and a second center tap 648 is associated with the second port 614.

The TLT 600 is configured in a manner that provides the following features. The TLT 600 provides a transformation ratio of 1:4 in the direction from the first port 612 to the second port 614. The first port impedance is equal to the characteristic line impedance and the second port impedance is equal to four times the characteristic line impedance. In other words, $Z_0$=R where $Z_0$ is the line impedance, R is the impedance of the first port 612, and 4R is the impedance of the second port 614. As in the other implementations described above, the first port 612 and the second port 614 are DC-isolated from each other. Also, as an option the circuit is capable of providing center taps 646, 678, 648 for both the input port 612 and the output port 614. Moreover, the TLT 600 is overall inverting—that is, the first port voltage, V, is phase-inverted relative to the second port voltage, −2V.

FIG. 6 illustrates one way of realizing the foregoing features. The circuit arrangement is generally similar to that of FIG. 5, except that a series-parallel connection is implemented on the side of the first port 612 and a fully series connection is implemented on the side of the second port 614. The first transmission line 642 includes a first conductor 654 and a second conductor 656, portions of which are wound about the core 640 to form the first wound portion 650. The second transmission line 644 includes a first conductor 658 and a second conductor 660, portions of which are wound about the core 640 to form the second wound portion 652 in the opposite sense to the first wound portion 650. The third transmission line 662 includes a first conductor 670 and a second conductor 672, portions of which are wound about the core 640 to form the third wound portion 666 in the opposite sense to the first wound portion 650. The fourth transmission line 664 includes a first conductor 674 and a second conductor 676, portions of which are wound about the core 640 to form the fourth wound portion 668 in the opposite sense to the third wound portion 666.

Continuing with FIG. 6, at the first end of the first wound portion 650, the first conductor 654 of the first transmission line 642 is in signal communication with the first node 632 of the first port 612. Also at the first end of the first wound portion 650, the second conductor 656 of the first transmission line 642 is in signal communication with the second conductor 672 of the third transmission line 662 (at the first end of the third wound portion 666). At the second end of the first wound portion 650, the second conductor 656 of the first transmission line 642 is in signal communication with the first node 636 of the second port 614. Also at the second end of the first wound portion 650, the first conductor 654 of the first transmission line 642 is in signal communication with the first conductor 670 of the third transmission line 662 (at the second end of the third wound portion 666). At the first end of the second wound portion 652, the first conductor 658 of the second transmission line 644 is in signal communication with the second node 634 of the first port 612. Also at the first end of the second wound portion 652, the second conductor 660 of the second transmission line 644 is in signal communication with the second conductor 676 of the fourth transmission line 664 (at the first end of the fourth wound portion 668). At the second end of the second wound portion 652, the second conductor 660 of the second transmission line 644 is in signal communication with the second node 638 of the second port 614. Also at the second end of the second wound portion 652, the first conductor 658 of the second transmission line 644 is in signal communication with the first conductor 674 of the fourth transmission line 664 (at the second end of the fourth wound portion 668). At the first end of the third wound portion 666, the first conductor 670 of the third transmission line 662 is in signal communication with the second node 634 of the first port 612. At the second end of the third wound portion 666, the second conductor 672 of the third transmission line 662 is in signal communication with the second conductor 676 of the fourth transmission line 664 (at the second end of the fourth wound portion 668). At the first end of the fourth wound portion 668, the first conductor 674 of the fourth transmission line 664 is in signal communication with the first node 632 of the first port 612.

By the foregoing configuration, the first transmission line 642, the second transmission line 644, the third transmission line 662, and the fourth transmission line 664 are connected in a series-parallel arrangement at the first port 612. Specifically, the first transmission line 642 and the third transmission line 662 are connected in series as a pair of transmission lines at the first port 612, and the second transmission line 644 and the fourth transmission line 664 are connected in series as another pair of transmission lines at the first port 612. The two resulting pairs of transmission lines are connected in parallel at the first port 612. The first transmission line 642, the second transmission line 644, the third transmission line 662, and the fourth transmission line 664 are all connected in series at the second port 614.

In some implementations, a first center tap associated with the first port and/or a second center tap associated with the second port may be provided. In the example illustrated in FIG. 6, two first center taps 646, 678 are implemented between the first wound portion 650 and the second wound portion 652 at the first port 612, and a second center tap 648 is implemented between the first wound portion 650 and the second wound portion 652 at the second port 614. More specifically, one first center tap 646 is implemented between the first wound portion 650 and the third wound portion 666, the other first center tap 678 is implemented between the second wound portion 652 and the fourth wound portion 668, and the second center tap 648 is implemented between the third wound portion 666 and the fourth wound portion 668. This tap configuration is realized by locating the first center tap 646 at the node between the first conductor 654 of the first transmission line 642 and the first conductor 670 of the third transmission line 662, locating the other first center tap 678 at the node between the first conductor 658 of the second transmission line 644 and the first conductor 674 of the fourth transmission line 664, and locating the second center tap 648 at the node between the second conductor 672 of the third transmission line 662 and the second conductor 676 of the fourth transmission line 664. In practice, if a center tap is required on the low-impedance port (the first port 612 in the present example), an advantageous arrangement would be to utilize both first center taps 646, 678 at once (i.e., connect them together) to optimize balance at high frequencies where parasitic circuit elements could cause appreciable deleterious effects.

As in the other implementations described above, the TLT 600 avoids the requirement for high-impedance coaxial cable or twin-lead when constructing transmission-line circuits having at least one high-impedance port. The attribute of $Z_0$=R enables, for example, the TLT 600 to be constructed as a 50-ohm to 200-ohm transformer using 50-ohm transmission line material or as a 75-ohm to 300-ohm transformer using 75-ohm transmission line material. Using the example of 50-ohm transmission line material, on the side of the first port 612 two pairs of 50-ohm transmission lines are each connected in series. The resulting pair of 100-ohm ports is then connected in parallel to make a 50-ohm net impedance at the first port 612. On the side of the second port 614 the four 50-ohm transmission lines are all connected in series to make 200 ohms Also, the 1:4 TLT 600 may be utilized with either or both ports 612, 614 referenced to ground or floating. The center taps 646, 678, 648 of the TLT 600 may be employed as described above. DC isolation exists between the ports 612, 614 of the TLT 600.

Figure 7:
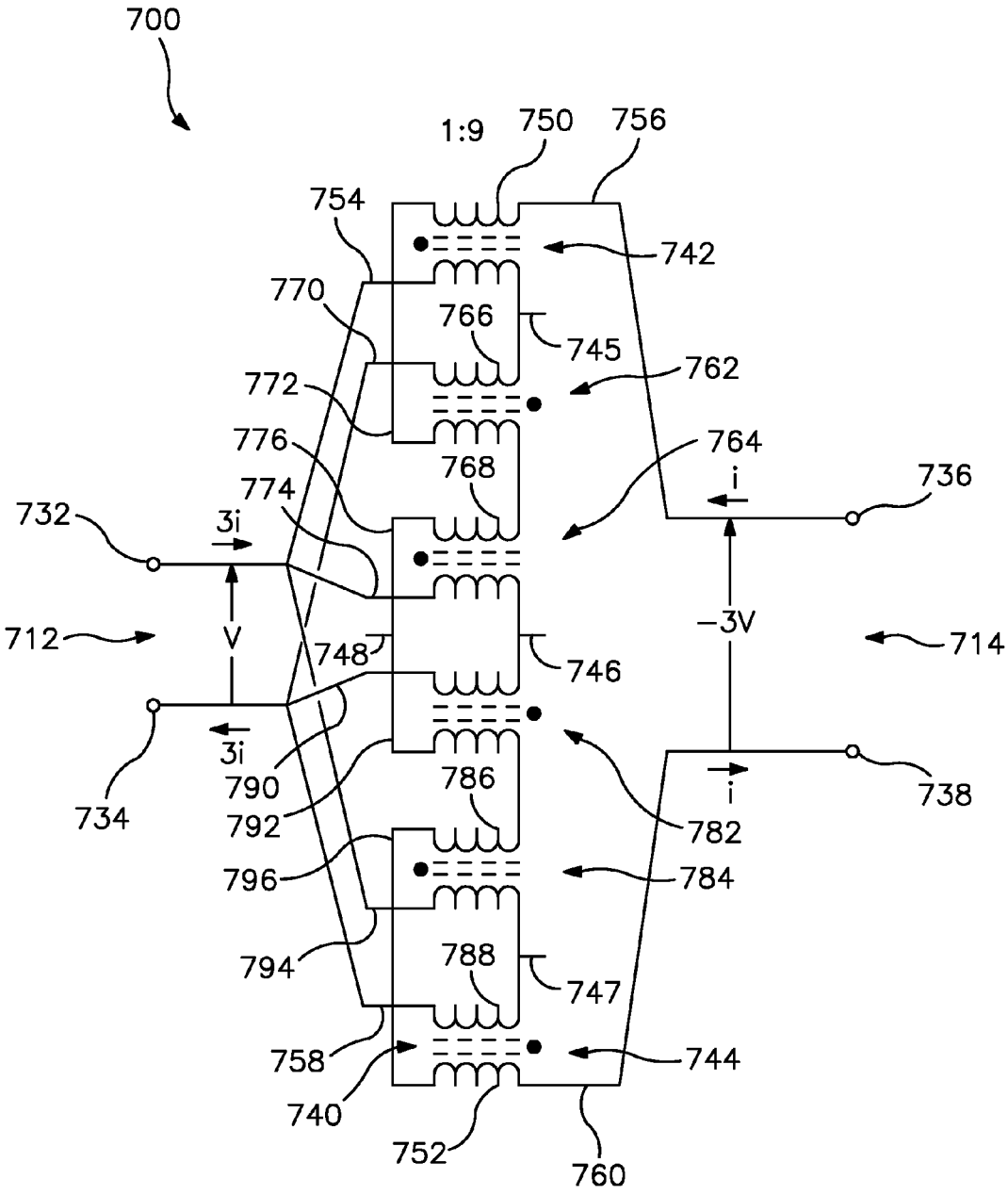
FIG. 7 is a schematic view of an example of a composite TLT provided in accordance with another implementation of the present teachings.

FIG. 7 is a schematic view of an example of a composite TLT 700 provided in accordance with another implementation of the present teachings. The TLT 700 generally includes a first port 712, a second port 714, and transformer circuitry in signal communication with the first port 712 and the second port 714. The first port 712 generally includes a first node 732 and a second node 734. The first port 712 has a first port impedance R, and exhibits a first port voltage between the first node 732 and the second node 734. The second port 714 generally includes a first node 736 and a second node 738. The second port 714 has a second port impedance 9R, and exhibits a second port voltage between the first node 736 and the second node 738. The circuitry between the first port 712 and the second port 714 generally includes at least one core 740. The circuitry further generally includes a first transmission line 742, a second transmission line 744, a third transmission line 762, a fourth transmission line 764, a fifth transmission line 782, and a sixth transmission line 784, at least portions of which are wound about the core(s) 740. Specifically, the first transmission line 742 includes a first wound portion 750, the second transmission line 744 includes a second wound portion 752, the third transmission line 762 includes a third wound portion 766, the fourth transmission line 764 includes a fourth wound portion 768, the fifth transmission line 782 includes a fifth wound portion 786, and the sixth transmission line 784 includes a sixth wound portion 788. The six wound portions 750, 752, 766, 768, 786, 788 may all be wound onto the same common core 740 or one or more separate cores. As indicated by the dots in FIG. 7, the first wound portion 750 is wound in a first winding direction and the second wound portion 752 is wound in a second winding direction that is opposite to the first winding direction. The third wound portion 766 is wound in the second winding direction, the fourth wound portion 768 is wound in the first winding direction, the fifth wound portion 786 is wound in the second winding direction, and the sixth wound portion 788 is wound in the first winding direction. In some implementations, the circuitry provides one or more center taps. In the illustrated example, a first center tap 746 is associated with the first port 712 and a second center tap 748 is associated with the second port 714.

The TLT 700 is configured in a manner that provides the following features. The TLT 700 provides a transformation ratio of 1:9 in the direction from the first port 712 to the second port 714. The first port impedance is equal to two-thirds of the characteristic line impedance and the second port impedance is equal to six times the characteristic line impedance. In other words, $Z_0$=(3/2)R where $Z_0$ is the line impedance, R is the impedance of the first port 712, and 9R is the impedance of the second port 714. As in the other implementation described above, the first port 712 and the second port 714 are DC-isolated from each other. Also, as an option the circuit is capable of providing center taps 746, 748 for both the input port 712 and the output port 714. Moreover, the TLT 700 is overall inverting—that is, the first port voltage, V, is phase-inverted relative to the second port voltage, −3V.

FIG. 7 illustrates one way of realizing the foregoing features. The circuit arrangement is generally similar to that of FIG. 6 in that a series-parallel connection is implemented on the side of the first port 712 and a fully series connection is implemented on the side of the second port 714, but two additional transmission lines 782, 784 are provided. The first transmission line 742 includes a first conductor 754 and a second conductor 756, portions of which are wound about the core 740 to form the first wound portion 750. The second transmission line 744 includes a first conductor 758 and a second conductor 760, portions of which are wound about the core 740 to form the second wound portion 752 in the opposite sense to the first wound portion 750. The third transmission line 762 includes a first conductor 770 and a second conductor 772, portions of which are wound about the core 740 to form the third wound portion 766 in the opposite sense to the first wound portion 750. The fourth transmission line 764 includes a first conductor 774 and a second conductor 776, portions of which are wound about the core 740 to form the fourth wound portion 768 in the opposite sense to the third wound portion 766. The fifth transmission line 782 includes a first conductor 790 and a second conductor 792, portions of which are wound about the core 740 to form the fifth wound portion 786 in the opposite sense to the first wound portion 750. The sixth transmission line 784 includes a first conductor 794 and a second conductor 796, portions of which are wound about the core 740 to form the sixth wound portion 788 in the opposite sense to the fifth wound portion 786.

Continuing with FIG. 7, at the first end of the first wound portion 750, the first conductor 754 of the first transmission line 742 is in signal communication with the first node 732 of the first port 712. Also at the first end of the first wound portion 750, the second conductor 756 of the first transmission line 742 is in signal communication with the second conductor 772 of the third transmission line 762 (at the first end of the third wound portion 766). At the second end of the first wound portion 750, the second conductor 756 of the first transmission line 742 is in signal communication with the first node 736 of the second port 714. Also at the second end of the first wound portion 750, the first conductor 754 of the first transmission line 742 is in signal communication with the first conductor 770 of the third transmission line 762 (at the second end of the third wound portion 766). At the first end of the second wound portion 752, the first conductor 758 of the second transmission line 744 is in signal communication with the second node 734 of the first port 712. Also at the first end of the second wound portion 752, the second conductor 760 of the second transmission line 744 is in signal communication with the second conductor 796 of the sixth transmission line 784 (at the first end of the sixth wound portion 788). At the second end of the second wound portion 752, the second conductor 760 of the second transmission line 744 is in signal communication with the second node 738 of the second port 714. Also at the second end of the second wound portion 752, the first conductor 758 of the second transmission line 744 is in signal communication with the first conductor 794 of the sixth transmission line 784 (at the second end of the sixth wound portion 788). At the first end of the third wound portion 766, the first conductor 770 of the third transmission line 762 is in signal communication with the second node 734 of the first port 712. At the second end of the third wound portion 766, the second conductor 772 of the third transmission line 762 is in signal communication with the second conductor 776 of the fourth transmission line 764 (at the second end of the fourth wound portion 768). At the first end of the fourth wound portion 768, the first conductor 774 of the fourth transmission line 764 is in signal communication with the first node 732 of the first port 712. Also at the first end of the fourth wound portion 768, the second conductor 776 of the fourth transmission line 764 is in signal communication with the second conductor 792 of the fifth transmission line 782 (at the first end of the fifth wound portion 786). At the first end of the fifth wound portion 786, the first conductor 790 of the fifth transmission line 782 is in signal communication with the second node 734 of the first port 712. At the second end of the fifth wound portion 786, the second conductor 792 of the fifth transmission line 782 is in signal communication with the second conductor 796 of the sixth transmission line 784 (at the second end of the sixth wound portion 788). At the first end of the sixth wound portion 788, the first conductor 794 of the sixth transmission line 784 is in signal communication with the first node 732 of the first port 712.

By the foregoing configuration, the transmission lines 742, 744, 762, 764, 782, 784 are connected in a series-parallel arrangement at the first port 712. Specifically, the first transmission line 742 and the third transmission line 762 are connected in series as a pair of transmission lines at the first port 712, the second transmission line 744 and the sixth transmission line are 784 connected in series as another pair of transmission lines at the first port 712, and the fourth transmission line 764 and the fifth transmission line 782 are connected in series as another pair of transmission lines at the first port 712. The three resulting pairs of transmission lines are connected in parallel at the first port 712. The transmission lines 742, 744, 762, 764, 782, 784 are all connected in series at the second port.

In some implementations, a first center tap 746 associated with the first port 712 and/or a second center tap 748 associated with the second port 714 may be provided. In the example illustrated in FIG. 7, at least one first center tap 746 is implemented between the first wound portion 750 and the second wound portion 752, and a second center tap 748 is implemented between the first wound portion 750 and the second wound portion 752 at the second port 714. More specifically, the first center tap 746 is implemented between the fourth wound portion 768 and the fifth wound portion 786, and the second center tap 748 is implemented between the fourth wound portion 768 and the fifth wound portion 786 on the opposite side. This tap configuration is realized by locating the first center tap 746 at the node between the first conductor 774 of the fourth transmission line 764 and the first conductor 790 of the fifth transmission line 782, and locating the second center tap 748 at the node between the second conductor 776 of the fourth transmission line 764 and the second conductor 792 of the fifth transmission line 782. Note that because the connections at the first port 712 include three paired windings, there are three potential center-tap connection points for the first port 712. Thus, in addition to the center tap 746, FIG. 7 shows a center tap 745 at the node between the conductors 754 and 770, and a center tap 747 at the node between the conductors 794 and 758. However, taking parasitic circuit elements into consideration, the connection point designated at 746 will yield the best balance at high frequencies and so is the preferred center tap. Alternatively, all three center taps 745, 746, 747 for the first port 712 may be connected in parallel to increase the DC current-carrying capacity if this is important in a given application.

As in the other implementations described above, the TLT 700 avoids the requirement for high-impedance coaxial cable or twin-lead when constructing transmission-line circuits having at least one high-impedance port. The attribute of $Z_0=(3/2)R$ enables, for example, the TLT 700 to be constructed as a 50-ohm to 450-ohm transformer using 75-ohm transmission line material. Using the example of 75-ohm transmission line material, on the side of the first port 712 three pairs of 75-ohm transmission lines are each connected in series. The resulting triplet of 150-ohm ports is then connected in parallel to make a 50-ohm net impedance at the first port 712. On the side of the second port 714 the six 75-ohm transmission lines are all connected in series to make 450 ohms As an example, a typical application of the TLT 700 would be interfacing between a 50-ohm transmitter output feed (referenced to ground) and a 450-ohm balanced antenna. Also, the 1:9 TLT 700 may be utilized with either or both ports 712, 714 referenced to ground or floating. The center taps 745/746/747 and 748 of the TLT 700 may be employed as described above. DC isolation exists between the ports 712, 714 of the TLT 700.

From the foregoing, it is evident that the TLTs described above and illustrated in FIGS. 4-7 by example each possess the following attributes. First, one or both port impedances can be high relative to the characteristic impedance of the transmission line used to construct the transformer. Although not illustrated in the above examples, the present teachings can also be applied to construct transformers having one or both port impedances that are low relative to the characteristic impedance of the transmission line material used. Second, broadband center-taps are available on both ports. Third, there is DC isolation between ports. Fourth, there is phase inversion between ports. Fifth, the TLT may be used with either or both ports floating or referenced to ground. Sixth, all windings may be wound onto a common core, although separate cores will also work. As to the latter attribute, for all possible port-connection configurations (floating-to-floating, floating-to-unbalanced, unbalanced-to-floating, and unbalanced to unbalanced), all the windings of the TLTs support equal voltage drops and equal currents, so they are all compatible, and mutually aid each other flux-wise when wound, in the appropriate direction, onto a common core. As compared to conventional TLTs, at least some of the foregoing attributes of the presently disclosed TLTs is unique when considered alone apart from the other attributes.

Although detailed descriptions and illustrations (FIGS. 4-7) have been provided for only four implementations, persons skilled in the art upon consideration of the present teachings will appreciate that numerous other implementations possessing one or more of the foregoing attributes may be conceived. Additionally, although specific impedance magnitudes have been described, it will be understood that these impedance magnitudes are not limiting and that other impedance levels may be realized by practicing the present teachings. It will further be noted that while FIGS. 4-7 each show a TLT in which the low-impedance port is on the left and the high-impedance port is on the right, or provide examples (e.g., 1:4, 1:9, etc.) that might imply that the low-impedance port is the input port and the high-impedance port is the output port, these are not limitations of the present disclosure. The TLTs may be operated to transform impedances down (e.g., 4:1, 9:1, etc.) as well as up, or with the high-impedance port utilized as the input port and the low-impedance port utilized as the output port. Although FIGS. 4-7 serve to illustrate transformers having at least one port operating at an impedance that is higher than that of the transmission line material used to construct the transformer, it will be appreciated by persons skilled in the art that the present teachings may be applied to construct transformers with one or both ports operating at an impedance lower than that of the transmission line material used to construct the transformer.

The preferred methods of construction for most applications will be to wind lengths of transmission line onto either a toroid or binocular (multi-aperture) ferrite core. In the case of TLTs operating at small-signal levels on printed circuit boards (PCBs), the transmission-line material will typically be bonded twin lead or twisted pair. In the case of higher power operation, miniature coaxial cable will typically be the preferred type of transmission line to use. Alternative embodiments may employ coaxial cable at low power levels or twin lead or twisted pair at high power levels. Other forms of transmission line such as stripline or microstrip, either flexible so it may be wound onto a core or rigid or printed on a PCB with the core clamping around it through holes in the PCB, may also be employed. Other shapes of cores, such as rods, pot-cores, beads, E-I cores, ribbons, strips, plates, or cylinders could also be utilized, although the broad aspects of the present teachings are not limited to the foregoing examples. With some types of cores, such as beads or clamp-on cores, the circuit may be constructed by threading or clamping one or more cores onto the transmission lines. This configuration has advantages in cases where it is desirable to have a significant physical separation between the input and output ports of the transformer. Core materials other than ferrite, such as powdered iron, solid iron, nickel, or some other ferrous or non-ferrous material may be appropriate in some applications. For convenience in the present disclosure, the term "wound" is intended to encompass all forms of operative arrangements between transmission lines and cores, whether such engagements entail actual winding or coiling or other arrangements such as threading, clamping, etc.

In some implementations the TLTs may be constructed with air cores, or in other words, no core, or may be printed onto a PCB with spiral or other shaped windings with or without any additional core material being employed. In cases that do not employ additional core material the TLTs typically display less bandwidth than when metal or ferrite cores are employed. For narrow-band air-core applications there are typically advantages to making the line lengths close to ¼ $m\lambda$ where m is any odd integer and $\lambda$ represents wavelength. Accordingly, as used herein the term "core" is intended to encompass either a solid core or an air core.

Figure 8A:
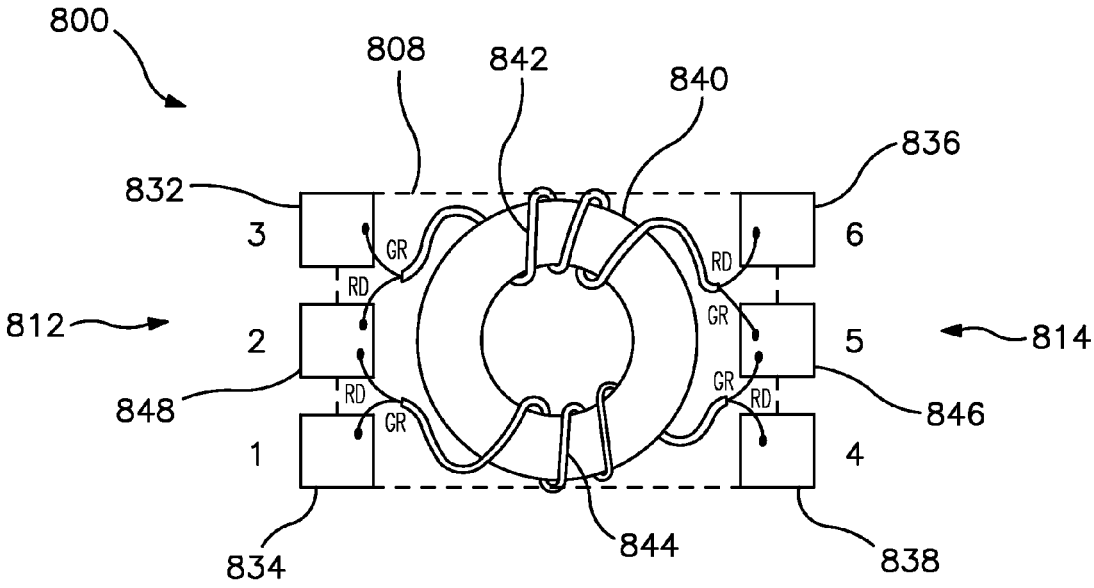
FIG. 8 is a top plan view of one example of a physical implementation of a single-core composite 1:1 TLT provided in accordance with the present teachings, along with a corresponding schematic diagram consistent with the physical implementation.
Figure 8B:
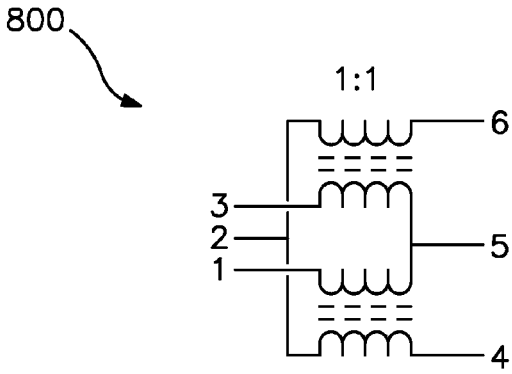

FIG. 8 is a top plan view of one example of a physical implementation of a single-core composite 1:1 TLT 800 provided in accordance with the present teachings, along with a corresponding schematic diagram consistent with the physical implementation. In the present example, the TLT 800 may be implemented as a surface-mount transformer mounted on a suitable PCB or carrier package 808. The TLT 800 includes a first port 812 and a second port 814. The first port 812 includes a first terminal 832 (terminal 3) and a second terminal 834 (terminal 1), and the second port 814 includes a first terminal 836 (terminal 6) and a second terminal 838 (terminal 4). In the present example, the terminals 832, 834, 836, 838 are implemented as bond pads or solder pads, or any other suitable electrical contact. The TLT 800 includes a small toroidal core 840 and two transmission lines 842, 844 wound (e.g., three turns each) on different sectors of the core 840. In the present example, the core 840 is a ferrite core and each transmission line 842, 844 is a standard 50-ohm twisted-pair transmission line with its two conductors being designated by red (RD) and green (GR) colors. Two center taps 846, 848 (terminals 5 and 2) are implemented in the same manner as the port terminals 832, 834, 836, 838. One end of the green conductor of the first transmission line 842 is connected to the first terminal 832 of the first port 812 and the other end is connected to the first center tap 846. One end of the red conductor of the first transmission line 842 is connected to the second center tap 848 and the other end is connected to the first terminal 836 of the second port 814. One end of the green conductor of the second transmission line 844 is connected to the second terminal 834 of the first port 712 and the other end is connected to the first center tap 846. One end of the red conductor of the second transmission line 844 is connected to the second center tap 848 and the other end is connected to the second terminal 838 of the second port 714. It will be appreciated that this is but one example of implementing the TLT 800.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A composite transmission line transformer, comprising:

at least one core;

a first port;

a second port; and one or more pairs of transmission lines wound about the at least one core, each transmission line being in signal communication with the first port and the second port, wherein for each pair, the transmission lines are interconnected in series at the first port and at the second port such that the first port and the second port are DC-isolated from each other.

2. The composite transmission line transformer of claim 1, wherein at least one of the first port and the second port has a center tap.

3. The composite transmission line transformer of claim 1, the first port and the second port each have a respective center tap.

4. The composite transmission line transformer of claim 1, wherein the at least one core comprises a single core and each transmission line is wound about the single core.

5. The composite transmission line transformer of claim 1, wherein both the first port and the second port are floating.

6. The composite transmission line transformer of claim 1, wherein both the first port and the second port are unbalance.

7. The composite transmission line transformer of claim 1, wherein one of the first port and the second port is floating and the other port is unbalanced.

8. The composite transmission line transformer of claim 1, wherein the at least one core comprises a plurality of cores.

9. The composite transmission line transformer of claim 1, wherein the first port is configured to exhibit a first port voltage, and the second port is configured to exhibit a second port voltage phase-inverted relative to the first port voltage.

10. The composite transmission line transformer of claim 1, wherein the first port has a first port impedance, the second port has a second port impedance, the transmission lines have a characteristic line impedance, and the one or more pairs of transmission lines are interconnected at each port such that the first port impedance is equal to or greater than the characteristic line impedance and the second port impedance is equal to or greater than the characteristic line impedance.

11. The composite transmission line transformer of claim 1, wherein the first port has a first port impedance, the second port has a second port impedance, the transmission lines have a characteristic line impedance, and the one or more pairs of transmission lines are interconnected at each port such that the first port impedance is equal to or less than the characteristic line impedance and the second port impedance is equal to or less than the characteristic line impedance.

12. The composite transmission line transformer of claim. 1, wherein the first port has a first port impedance, the second port has a second port impedance, the transmission lines have a characteristic line impedance, and the one or more pairs of transmission lines are interconnected at each port such that one of the first port impedance and the second port impedance is greater than the characteristic line impedance and the other port impedance is less than the characteristic line impedance.

13. The composite transmission line transformer of claim 1, wherein the impedance transformation ratio in a direction from the first port to the second port is $1:N^2$ where N is any positive integer.

14. The composite transmission line transformer of claim 1, wherein the one or more pairs of transmission lines comprise a first transmission line and a second transmission line, the first transmission line comprises a first wound portion wound about the at least one core in a first winding direction, the second transmission line comprises a second wound portion wound about the at least one core in a second winding direction opposite to the first winding direction, and the first transmission line and the second transmission line are connected in series at the first port and at the second port.

15. The composite transmission line transformer of claim 1, wherein:

the one or more pairs of transmission lines comprise a first transmission line, a second transmission line, a third transmission line and a fourth transmission line, the first transmission line comprising a first wound portion wound about the at least one core in a first winding direction, the second transmission line comprising a second wound portion wound about the at least one core in a second winding direction opposite to the first winding direction, the third transmission line comprising a third wound portion wound about the at least one core in the second winding direction, and the fourth transmission line comprising a fourth wound portion wound about the at least one core in the first winding direction; and the first transmission line, the second transmission line, the third transmission line and the fourth transmission line are connected in series at the first port and at the second port.

16. The composite transmission line transformer of claim 1, wherein:

the one or more pairs of transmission lines comprise a first transmission line, a second transmission line, a third transmission line and a fourth transmission line, the first transmission line comprising a first wound portion wound about the at least one core in a first winding direction, the second transmission line comprising a second wound portion wound about the at least one core in a second winding direction opposite to the first winding direction, the third transmission line comprising a third wound portion wound about the at least one core in the second winding direction, and the fourth transmission line comprising a fourth wound portion wound about the at least one core in the first winding direction;

the first transmission line and the third transmission line are connected as a first transmission line pair in series at the first port;

the second transmission line and the fourth transmission line are connected as a second transmission line pair in series at the first port;

the first transmission line pair and the second transmission line pair are connected in parallel at the first port; and the first transmission line, the second transmission line, the third transmission line and the fourth transmission line are connected in series at the second port.

17. The composite transmission line transformer of claim 1 wherein:

the one or more pairs of transmission lines comprise a first transmission line, a second transmission line, a third transmission line, a fourth transmission line, a fifth transmission line and a sixth transmission line, the first transmission line comprising a first wound portion wound about the at least one core in a first winding direction, the second transmission line comprising a second wound portion wound about the at least one core in a second winding direction opposite to the first winding direction, the third transmission line comprising a third wound portion wound about the at least one core in the second winding direction, the fourth transmission line comprising a fourth wound portion wound about the at least one core in the first winding direction, the fifth transmission line comprising a fifth wound portion wound about the at least one core in the second winding direction, and the sixth transmission line comprising a sixth wound portion wound about the at least one core in the first winding direction;

the first transmission line and the third transmission line are connected as a first transmission line pair in series at the first port;

the second transmission line and the sixth transmission line are connected as a second transmission line pair in series at the first port;

the fourth transmission line and the fifth transmission line are connected as a third transmission line pair in series at the first port;

the first transmission line pair, the second transmission line pair and the third transmission line pair are connected in parallel at the first port; and the first transmission line, the second transmission line, the third transmission line, the fourth transmission line, the fifth transmission line and the sixth transmission. line are connected in series at the second port.

18. A composite transmission line transformer, comprising:

at least one core;

a first port;

a second port; and one or more pairs of transmission lines wound about the at least one core, each transmission line being in signal communication with the first port and the second port, wherein for each pair, the transmission lines are interconnected in series at the first port and at the second port such that the first port and the second port are DC-isolated from each other, wherein the first port has a first port impedance, the second port has a second port impedance, the transmission lines have a characteristic line impedance, and the one or more pairs of transmission lines are interconnected at each port such that at least one of the first port impedance and the second port impedance is greater than the characteristic line impedance by a factor of at least two.

19. The composite transmission line transformer of claim 18, wherein one of the first port impedance and the second port impedance is equal to the line impedance.

20. The composite transmission line transformer of claim 18, wherein one of the first port impedance and the second port impedance is less than the line impedance.

* * * * *

UNITED STATES PATENT AND TRADEMARK OFFICE

CERTIFICATE OF CORRECTION

PATENT NO. : 8,456,267 B2
APPLICATION NO. : 12/780775
DATED : June 4, 2013
INVENTOR(S) : Michael J. Schoessow It is certified that error appears in the above-identified patent and that said Letters Patent is hereby corrected as shown below:

On title page, item (56), under "Other Publications" in column 2, line 5, delete "braodband" and insert -- broadband --, therefor.

In the Claims:

In column 17, line 28, In Claim 3, after "claim 1" insert -- wherein --.

In column 17, line 37, In Claim 6, delete "unbalance." and insert -- unbalanced. --, therefor.

In column 17, line 63, In Claim 12, delete "claim." and insert -- claim --, therefor.

In column 18, line 63, In Claim 17, delete "claim 1" and insert -- claim 1, --, therefor.

In column 20, line 1, In Claim 17, delete "transmission." and insert -- transmission --, therefor.

Signed and Sealed this
Seventeenth Day of September, 2013

Teresa Stanek Rea

Teresa Stanek Rea
*Deputy Director of the United States Patent and Trademark Office*